US005974706A

United States Patent [19]

Kaczmarski et al.

[11] Patent Number: 5,974,706

[45] Date of Patent: Nov. 2, 1999

[54] ATTACHMENT CONSTRUCTION FOR EARTHWORKING IMPLEMENT

[75] Inventors: Wally L. Kaczmarski, Lisbon; Thomas M. Sagaser, Bismarck; Craig A. Berard, Oakes; Henry J. Weber; Jason J. Asche, both of Bismarck, all of N. Dak.

[73] Assignee: Clark Equipment Company, Woodcliff Lake, N.J.

[21] Appl. No.: 08/814,313

[22] Filed: Mar. 10, 1997

[51] Int. Cl.[6] ..... E02F 3/36; E02F 3/40

[52] U.S. Cl. ..... 37/468; 414/723

[58] Field of Search ..... 172/272, 275; 37/468, 903; 414/723

[56] References Cited

U.S. PATENT DOCUMENTS

| | | | |
|---|---|---|---|
| 2,963,183 | 12/1960 | Przybylski . | |
| 3,237,795 | 3/1966 | Kromer . | |
| 4,213,731 | 7/1980 | Verachtert | 414/723 |
| 4,214,840 | 7/1980 | Beales | 403/31 |
| 4,225,283 | 9/1980 | Baker et al. | 414/723 |
| 4,477,101 | 10/1984 | Nilsson et al. | 172/272 X |
| 4,480,955 | 11/1984 | Andrews et al. | 414/723 |
| 4,632,595 | 12/1986 | Schaeff | 403/330 |
| 4,929,143 | 5/1990 | Dohnalik | 414/723 |
| 5,024,010 | 6/1991 | Huldén | 37/468 X |
| 5,082,389 | 1/1992 | Balemi | 403/322 |
| 5,098,252 | 3/1992 | Sheesley et al. | 414/723 |
| 5,107,610 | 4/1992 | Fusco | 37/103 |
| 5,110,254 | 5/1992 | Aubrey | 414/723 |
| 5,145,313 | 9/1992 | Weyer | 414/723 |
| 5,147,173 | 9/1992 | Fauber et al. | 414/723 |
| 5,332,353 | 7/1994 | Arnold | 414/723 |
| 5,333,695 | 8/1994 | Walter | 172/272 |
| 5,350,250 | 9/1994 | Nagler | 403/316 |
| 5,415,235 | 5/1995 | Gebauer | 37/468 X |
| 5,431,528 | 7/1995 | Jenkins et al. | 37/468 X |
| 5,597,283 | 1/1997 | Jones | 37/468 X |
| 5,692,325 | 12/1997 | Kuzutani | 37/468 |
| 5,727,342 | 3/1998 | Horton | 37/468 |

FOREIGN PATENT DOCUMENTS

| | | | |
|---|---|---|---|
| 1071151 | 2/1980 | Canada | 37/468 |
| 0 321 902 A1 | 6/1989 | European Pat. Off. . | |
| 0 472 115 | 2/1992 | European Pat. Off. . | |
| 0 521 560 B1 | 1/1993 | European Pat. Off. . | |
| 0 637 649 | 2/1995 | European Pat. Off. . | |
| 0 672 796 | 9/1995 | European Pat. Off. . | |
| 672796 A1 | 9/1995 | European Pat. Off. . | |
| 2 690 718 | 11/1993 | France . | |
| 90 00 721 | 4/1990 | Germany . | |
| 7904335 | 12/1980 | Netherlands | 37/468 |
| 763531 | 9/1980 | U.S.S.R. | 37/468 |
| 2 040 262 | 8/1980 | United Kingdom . | |
| 2 068 332 | 8/1981 | United Kingdom . | |
| 2169582 | 7/1986 | United Kingdom | 37/468 |
| 8802421 | 4/1988 | WIPO | 37/468 |

*Primary Examiner*—Christopher J. Novosad

*Attorney, Agent, or Firm*—Westman, Champlin & Kelly, P.A.

[57] ABSTRACT

A bracket and frame assembly permits attaching and removing a bucket or other tool to and from an arm of an excavator, backhoe, or the like. The bracket and frame assembly comprises two portions, a bracket and a detachable frame. The bracket mounts onto the arm of the implement. The bracket carries a latch member. The bracket can be moved onto a frame on a bucket or other tool, and is latched in place without dismounting from the backhoe, excavator or the like. The latch member can be released, either manually or under power, and then by manipulating the arm, the tool and frame can be removed from the bracket and a new tool mounted. The engaging portions of the frame and bracket are such that as wear occurs, the parts will compensate and remain secured without play or slop.

18 Claims, 13 Drawing Sheets

ATTACHMENT CONSTRUCTION FOR EARTHWORKING IMPLEMENT

BACKGROUND OF THE INVENTION

The present invention relates to interchangeable tool attachments powered such as a bucket, a grapple, hydraulic hammer, tampers, augers and the like used with a power operated arm of an implement such as an excavator or backhoe. The tools use a common frame mounting for coupling to a quick attachment bracket as shown in the present invention. The tools also are made to receive a separate mounting plate for regular pin connection to the arm.

Efforts have been made to provide couplings that can automatically connect tools to an articulated arm of an excavator, backhoe or the like, but most of these require operator action, as well as lacking reliability. Many of the present quick attachment brackets are complicated and time consuming in operation, requiring mechanically removing pins for connection as well as disconnection. One of the prior art couplings is illustrated in U.S. Pat. No. 5,110,254. Problems can persist with wear as the unit is used, in that there is no adequate compensation to take care of wear that occurs.

SUMMARY OF THE INVENTION

The present invention relates to a quick attachment bracket assembly for attaching various tools to an excavator, backhoe, or other powered implement that includes a power operated arm or boom. The specific embodiment shown is an excavator arm that has an actuator for pivoting a bucket or grapple around a horizontal axis, and also has actuators for manipulating the arm. In the present invention, a bucket or grapple has mounting walls on which a selected frame for either pin mounting or quick attach mounting can be fixed with no modification to the frames.

In a preferred form of the present invention a quick attachment frame is on the tool and the frame couples to a quick attachment bracket mounted to the arm and connected to the operating linkage used for controlling the tool so that the quick attachment bracket can be pivoted about a horizontal axis under power. The quick attachment bracket carries a spring loaded latch member that is pivotally mounted on the bracket so it will pivot from a position wherein it will engage and hold a frame that is welded or pinned in place on a tool, such as a bucket or a grapple hook. The quick attachment bracket is made to slide into place on the frame on the tool. As the bracket slides into place under power operation of the mounting arm, the latch pivots against its spring load to accommodate the movement of the bracket relative to the frame. As the bracket seats in position on the frame, the latch snaps into place under the spring load to securely hold the frame on the bracket.

The primary contact points for carrying loads from the tool (bucket or grapple) automatically adjusts for wear and manufacturing tolerances, so that the tool remains tight fitting on the bracket and will not excessively loosen as wear occurs.

Additionally, the quick attachment bracket carries a pin that protrudes from side plates of the bracket. The frame on the tool has spaced side plates with hooks at the outer ends that straddle the side plates on the attachment bracket so the tool can be supported on the pin to permit ease of maneuverability of the bucket during the coupling and uncoupling operation. This permits the operator to move the tool after the bracket and frame are unlatched or uncoupled. The frame and tool will hang suspended from the bracket when the hooks are engaged with the pin, and the tool, such a bucket, can be placed with one side on the ground for the latching operation.

DETAILED DESCRIPTION OF THE PREFERRED EMBODIMENTS

Figure 1:
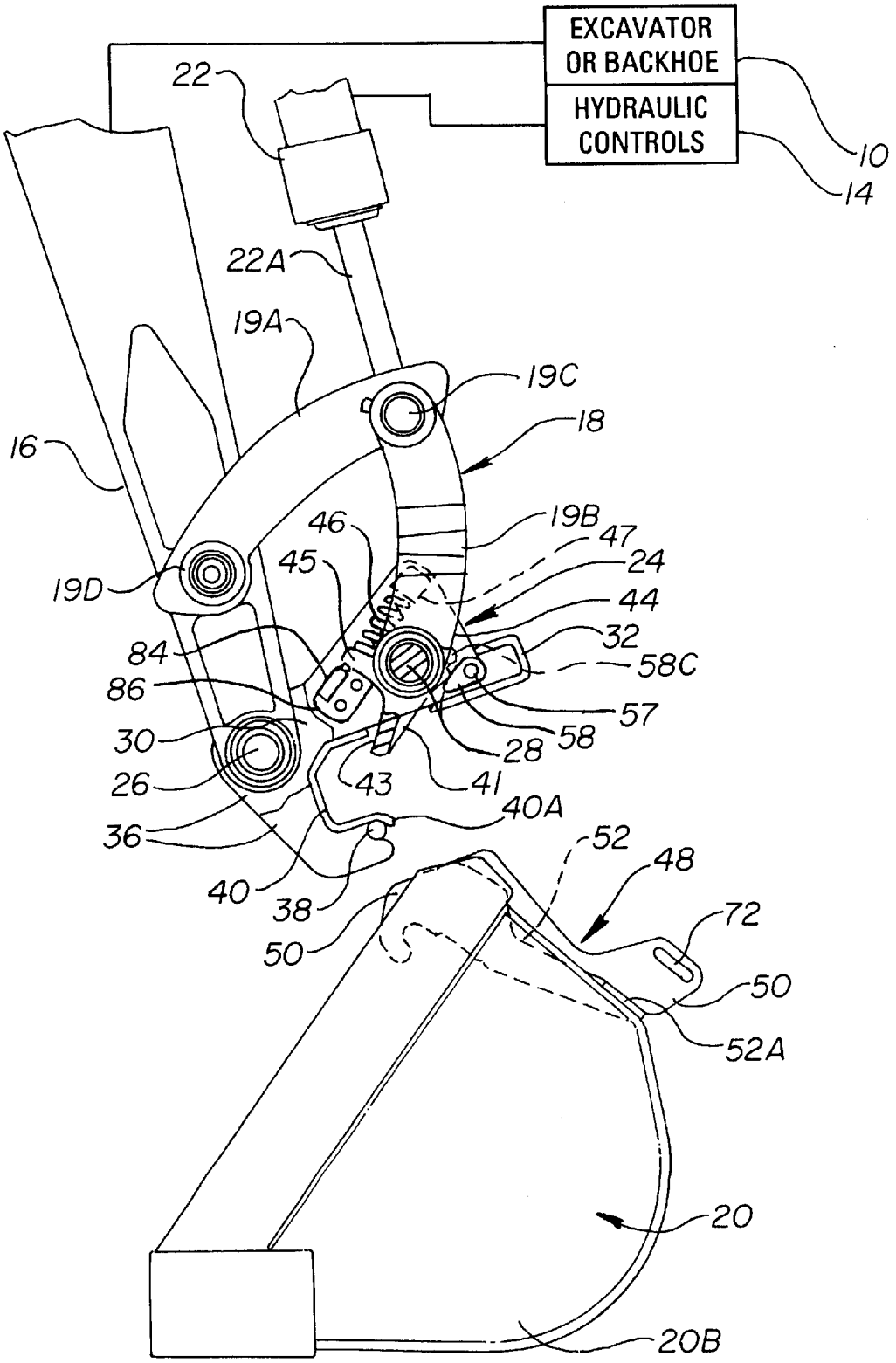
FIG. 1 is a schematic side elevational view of a typical excavator arm end portion having a quick attachment bracket made according to the present invention installed thereon and shown adjacent a tool, comprising a bucket, for attachment.

A powered implement, such as an excavator or backhoe 10 is shown only as block since such implements are well known. The implement has an arm illustrated fragmentarily at 16. The arm 16 is pivotally mounted to a base arm section and the base arm is pivoted to the implement 10. The arm 16 is controlled and operated from the implement 10 mounting platform, using hydraulic actuators from a source of hydraulic fluid under pressure, operated through controls, such as valves 14. An end portion of the arm 16 includes a link assembly 18 that is used for controlling a pivoting tool, such as bucket 20. The link is actuated with a double acting hydraulic actuator shown only schematically at 22 and operated through controls 14. The actuator 22 extends and retracts an actuator rod 22A under power and controls a tool, as shown by controlling pivotal movement of a quick attachment mounting bracket 24 that is pivotally mounted on a pin 26 to the outer end of the arm 16. The actuator, acting through linkage 18 will control then pivoting of the bracket about the horizontal axis of the pin 26.

The link assembly 18 as shown, has a pair of links 19A and 19B that are pivotally mounted together with a pin 19C. The pin 19C also is the attachment pin for the actuator rod, 22A. The links 19A and 19B are suitably bifurcated to have multiple attachments on the single pin. The link 19A is pivotally mounted to the boom or arm 16 at the pin 19D and the outer end of link 19B is pivotally mounted to quick attachment bracket 24 with a pin 28.

Figure 3:
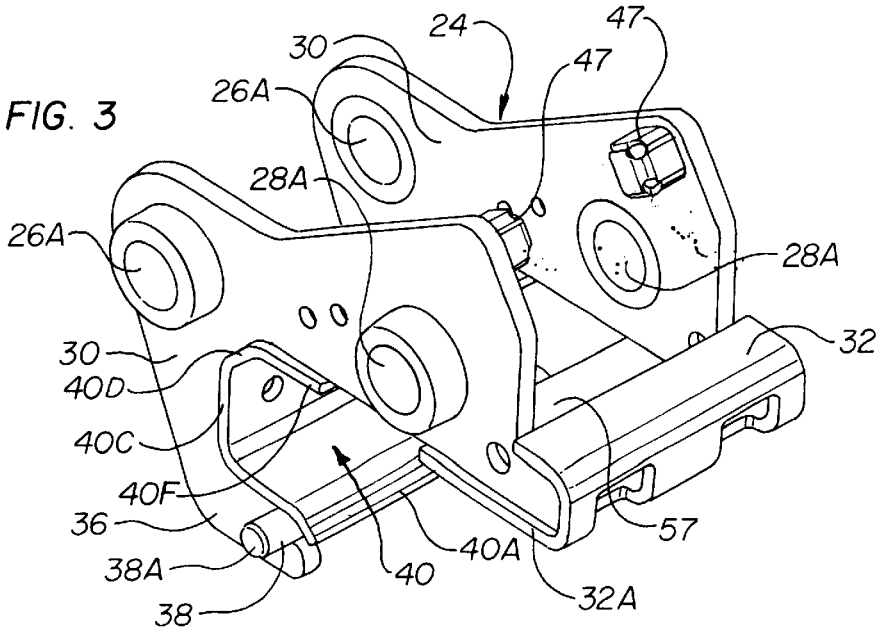
FIG. 3 is a first perspective view of the quick attachment bracket removed from the excavator arm showing the arm mounting side.
Figure 4:
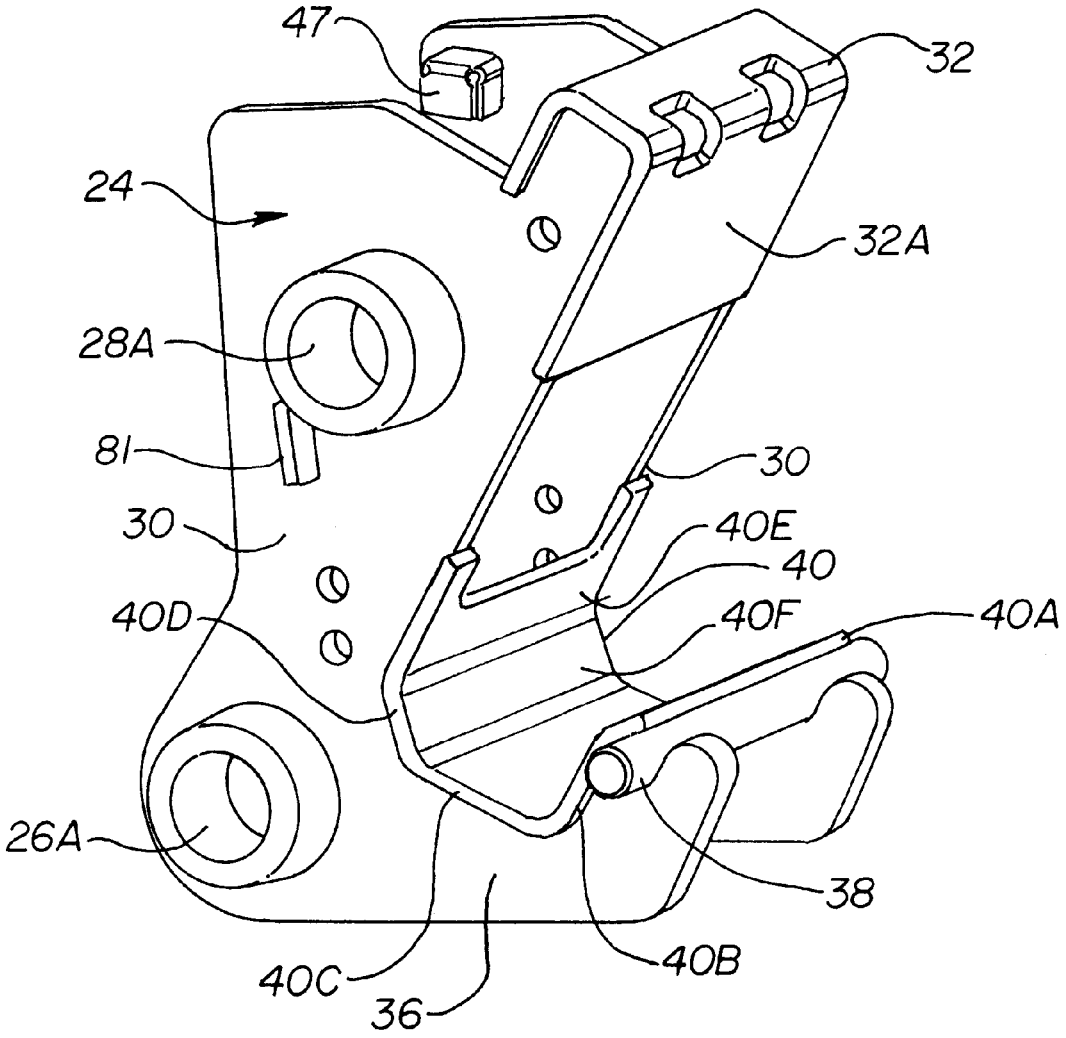
FIG. 4 is a perspective view of the quick attachment bracket shown in FIG. 3 viewed from the side that faces the tool in mounting.

The quick attachment bracket 24 is shown in FIGS. 3 and 4 individually and also in FIG. 1 when installed on arm 16. The quick attachment bracket 24 has a pair of side plates 30, 30 that form a support for a nose piece wrapper or end portion 32 that extends across the space between the side plates 30 and is welded to the side plates 30 to form an assembly. The side plates 30 are formed to have lower support ears 36 that are recessed to support a channel shaped saddle or retainer channel 40 that also is a cross member extending across the space between the side plates 30 and is welded thereto to secure the opposite end of the quick attachment bracket 24. The side plates 30 receive the main mounting pin 26 through bores 26A and the pin 26 extends across the space between the side plates 30. The linkage pin 28 also extends through bores 28A and extends across the space between the side plates 30.

A pin 38 is supported on the outer ends of the ears 36 and is held in place partially under a lead-in lip 40A on one outer edge of the channel shaped saddle 40. The pin 38 extends outwardly beyond the side plates 30 to provided support ends 38A, which are used to support the tool or bucket 20 during mounting and releasing the bucket 20 from the quick attachment bracket 24.

Figure 6:
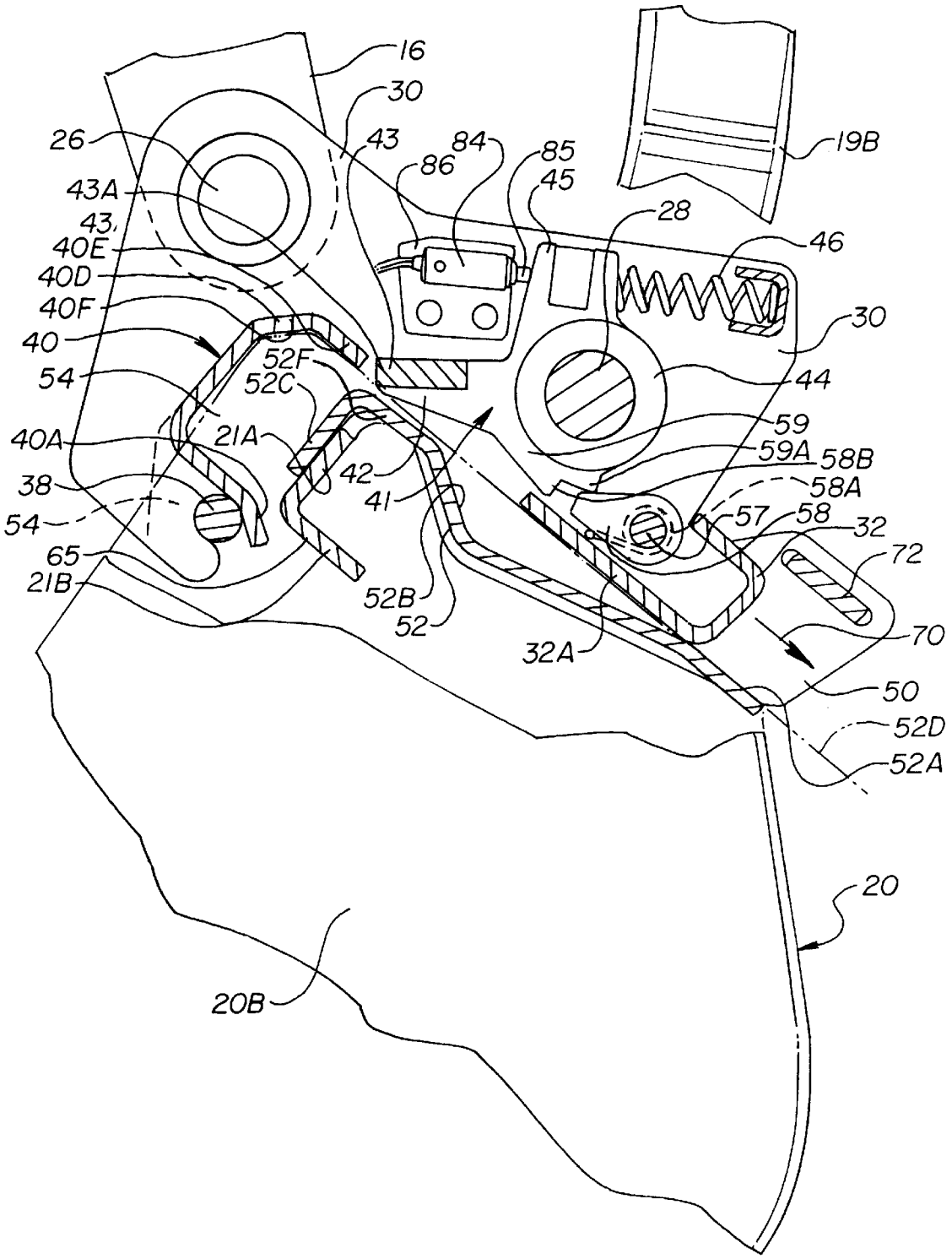
FIG. 6 is a view similar to FIG. 5 showing the arm and quick attachment bracket mating with a frame on the bucket.
Figure 7:
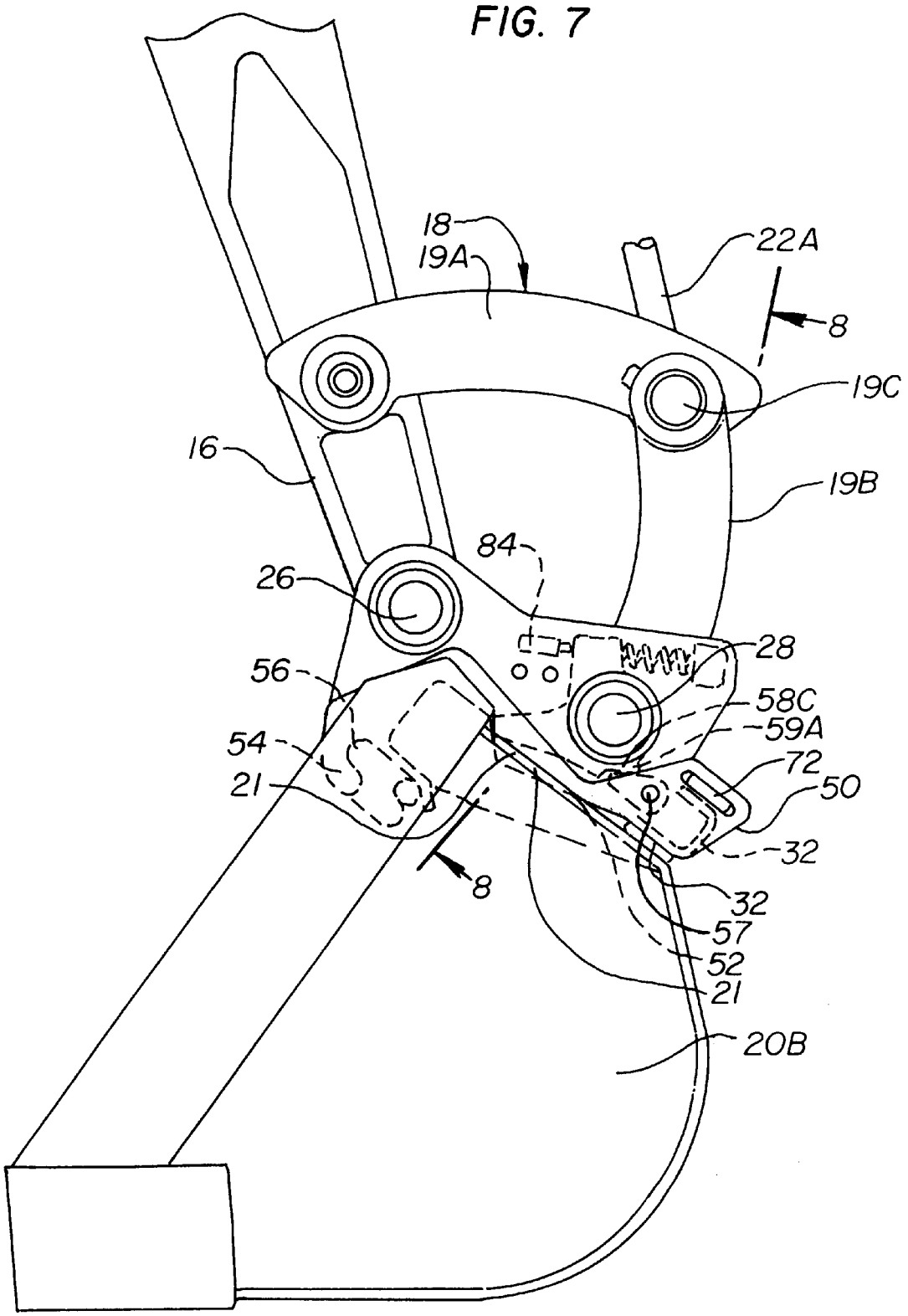
FIG. 7 is a view similar to FIG. 5 illustrating the quick attachment bracket in a latched position with the bucket frame.
Figure 9:
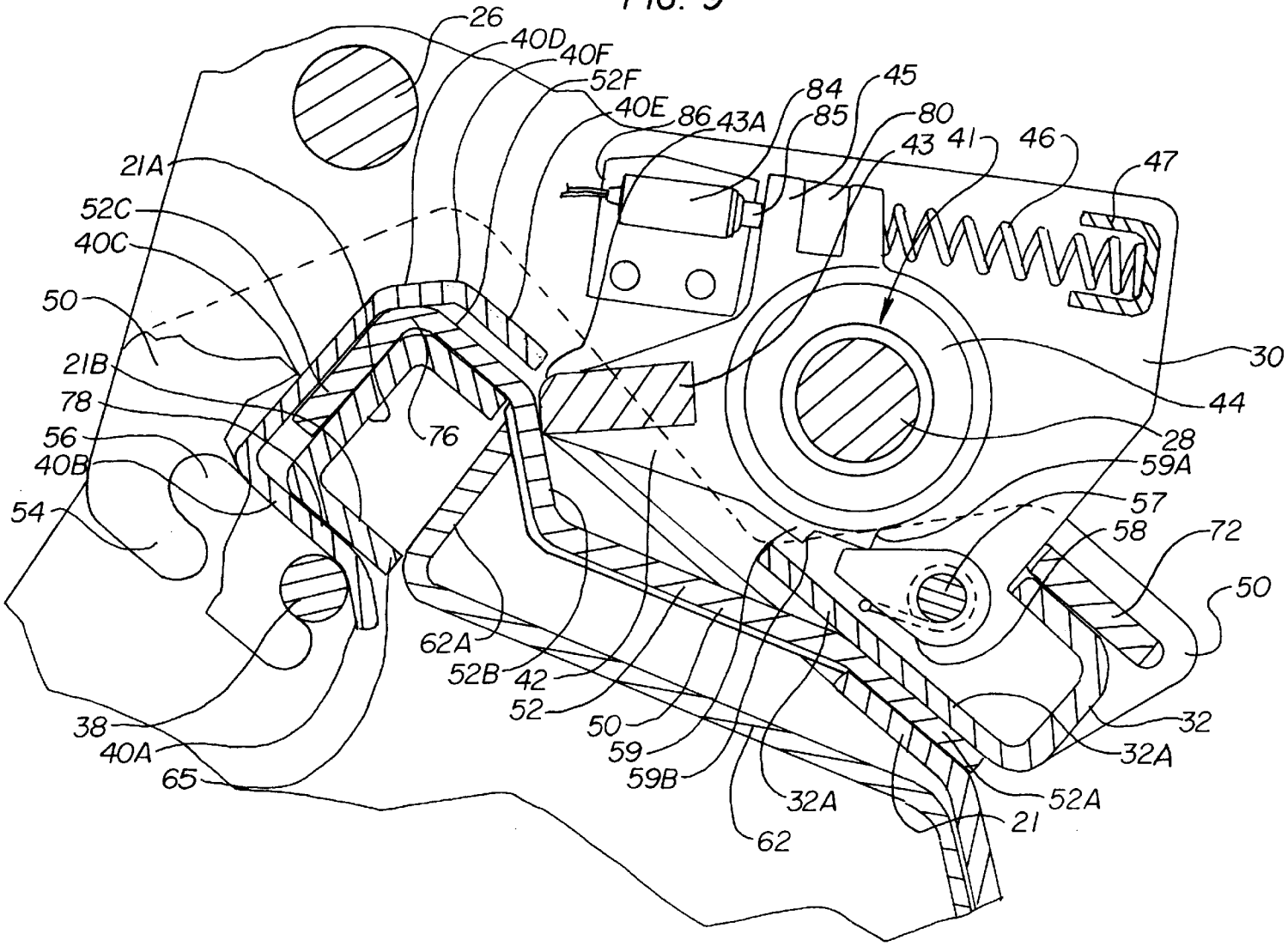
FIG. 9 is a fragmentary enlarged sectional view of the quick attachment bracket and tool frame shown in latched position.
Figure 10:
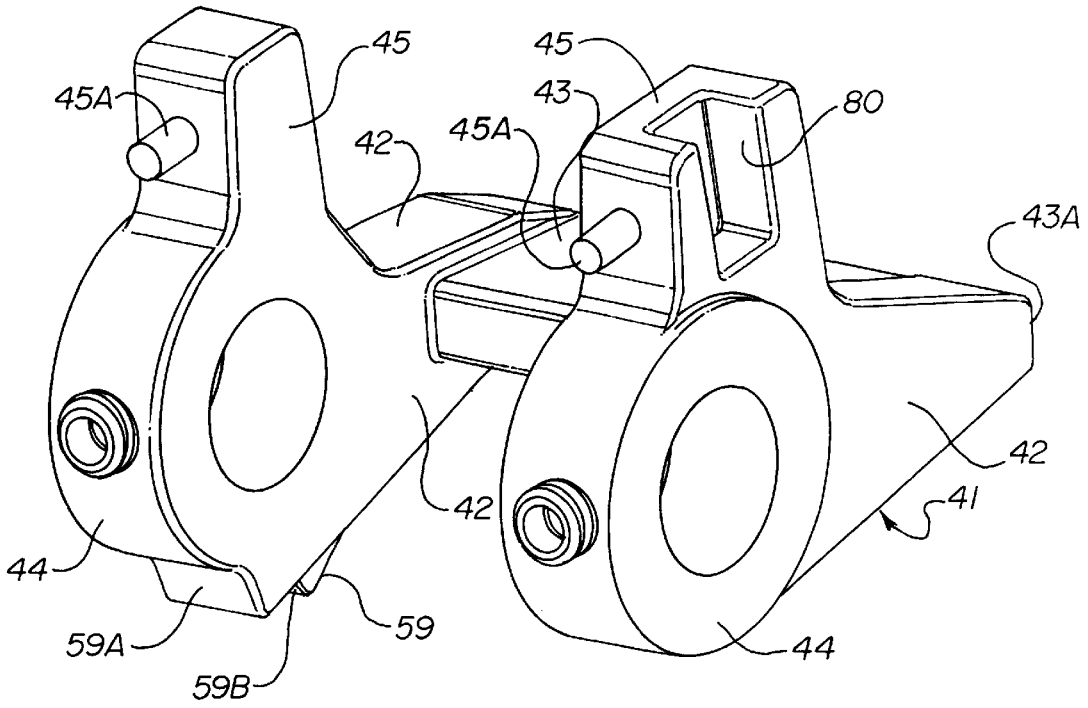
FIG. 10 is a perspective view of the latch used for holding the bucket frame in mounted position.

The pivot pin 28 also mounts a frame latch 41 shown in perspective view in FIG. 10 detached from the bracket 24, and also shown in FIGS. 1, 6,9 and others. The latch 41 is a yoke shaped member that has a pair of latch arms 42 held together with a latch bar 43 at their outer ends. The arms 42 have hubs 44, 44 that also are shown in FIG. 10. The hubs 44 have bores that pivotally mount over the shaft 28 and grease fitting bores are shown in FIG. 10 for lubrication for ease of pivoting. The hubs 44 have control arms 45, extending therefrom and the arms 45 are spring loaded with strong compression springs 46 that are retained in spring supports 47 that are fixed to the side plates 30 and bear against the arms 45. Roll pins 45A are provided on the control arms 45 to retain the springs 46 in place. The end 43A of the latch 41 is rounded with a large radius for smooth engagement when latching.

The latch 41 is thus urged by the springs 46 to rotate in counterclockwise direction as shown in FIG. 1, and are retained from rotating too far by suitable stops that will be explained.

Figure 2:
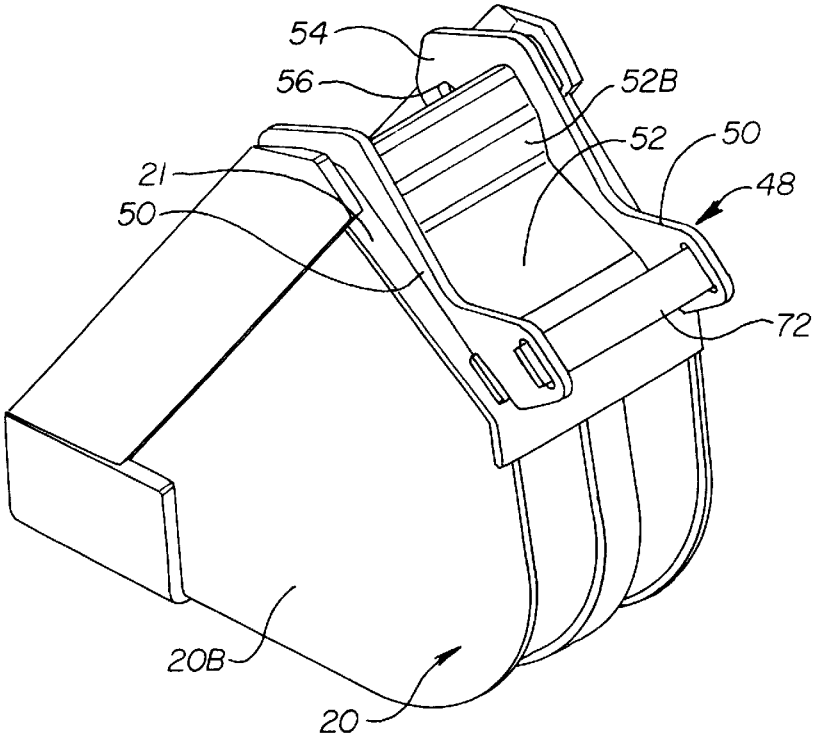
FIG. 2 is a perspective view of a bucket showing the bucket mounting frame in position on the back wall thereof.

The bucket 20 has a quick attachment frame 48 attached thereto. The quick attachment frame 48 is shown in FIG. 2 in perspective view and in enlarged cross sectional view in FIGS. 9 and 11. The frame 48 is made up of side plates 50, 50 that are welded to a latch backing plate 52. The side plates 50 have hook ends 54 with receptacles 56 formed in them (see FIGS. 5 and 6).

The side plates 50 of the frame 48 are spaced wider than the side plates 30 and wider than the nose piece 32 and the saddle 40 and will fit over the outside of the quick attachment bracket 24 when the bracket seats in the frame 48. The frame 48 also seats between the side plates 20A and 20B of the bucket 20. The frame 48 is welded to a back wall 21 of the bucket 20, which is formed separately and becomes an integral part of the frame 48, as will be explained.

The latch 41 is held in its "ready" position shown in FIG. 1 when the bracket is ready to be used in any selected way, and as shown a pivoting pawl 58 is mounted on a shaft 57, on at least one side of the latch aligns with a hub of the latch and as shown in FIG. 6, it is positioned to engage a stop lug 59 integral with a hub 44 aligning with the pawl 58. The stop lug has a stop surface 59A for holding the latch retracted for a release position and has a second surface 59B which is used to hold the latch in the ready position as shown in FIG. 1. The pawl is spring loaded with a torsion spring 58A to rotate in clockwise direction as shown in FIG. 6. The torsion spring 58A is shown only schematically. Thus the end of the latch protrudes into the area overlying the channel 40 when it is in its ready position.

The plate 52 of the frame 48 is formed to provide support for the quick attachment bracket 24 and as perhaps best understood from the showing in FIG. 6, includes a planar flange portion 52A at one end, near the bottom of the bucket 20 when the bucket is working. In the mid portions of the plate 52 the plate bends inwardly through an opening 21C in the rear wall 21 of the bucket 20, and then an inclined latch wall section 52B is formed to extend back outwardly. The plate has a section 52F that is coplanar with flange 52A and the end of the plate 52 then has a rim flange 52C formed at right angles to the plane of the planar flange 52A and the wall section 52F, which plane is illustrated at 52D in FIGS. 5 and 6. The rim flange 52C forms a rim which is seated in a receptacle formed in the ears 54 of the side plates 50 of the frame 48.

Figure 11:
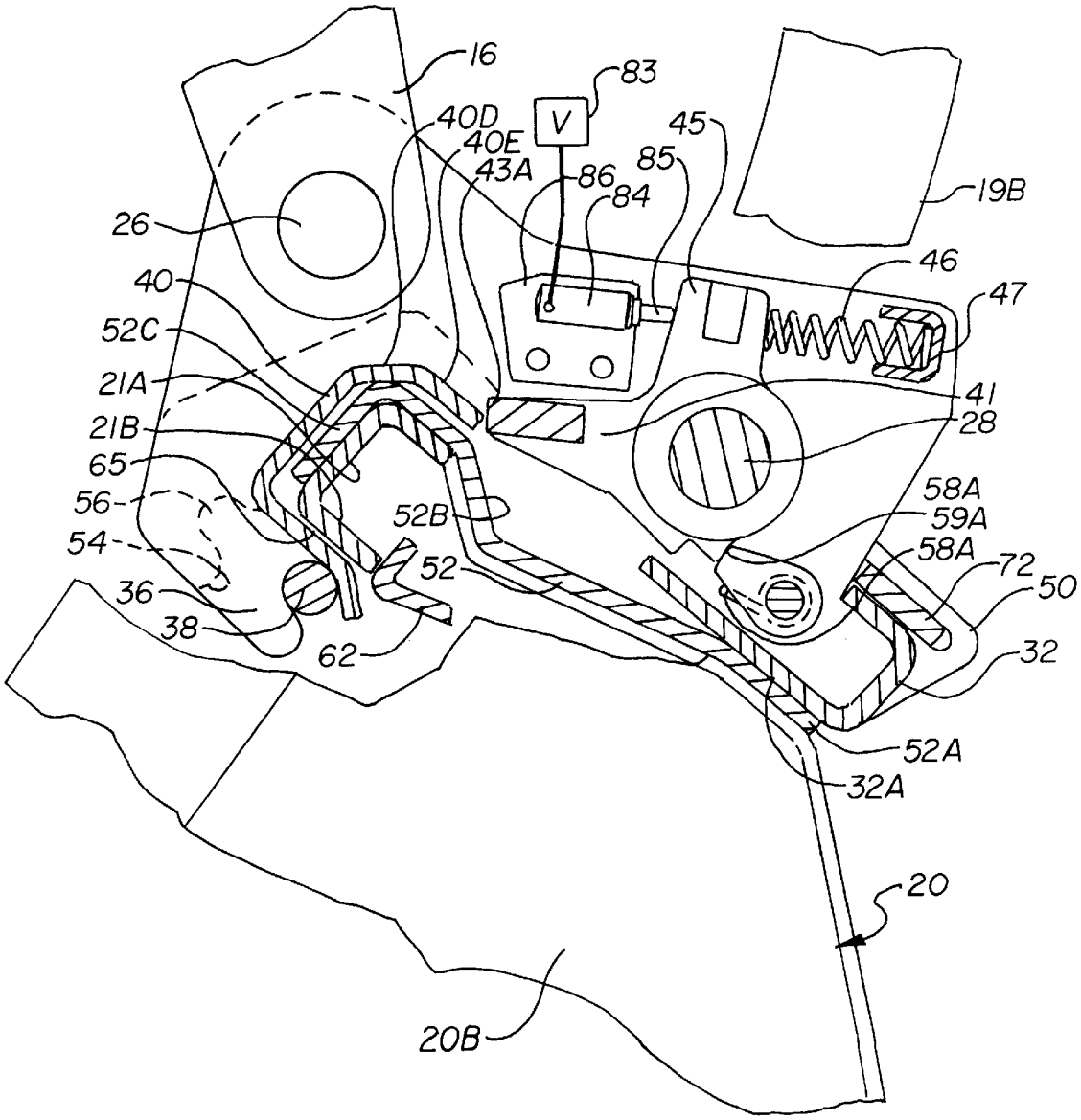
FIG. 11 is an enlarged view with parts removed and broken away showing the quick attachment bracket in a first stage of unlatching from the bucket.
Figure 13:
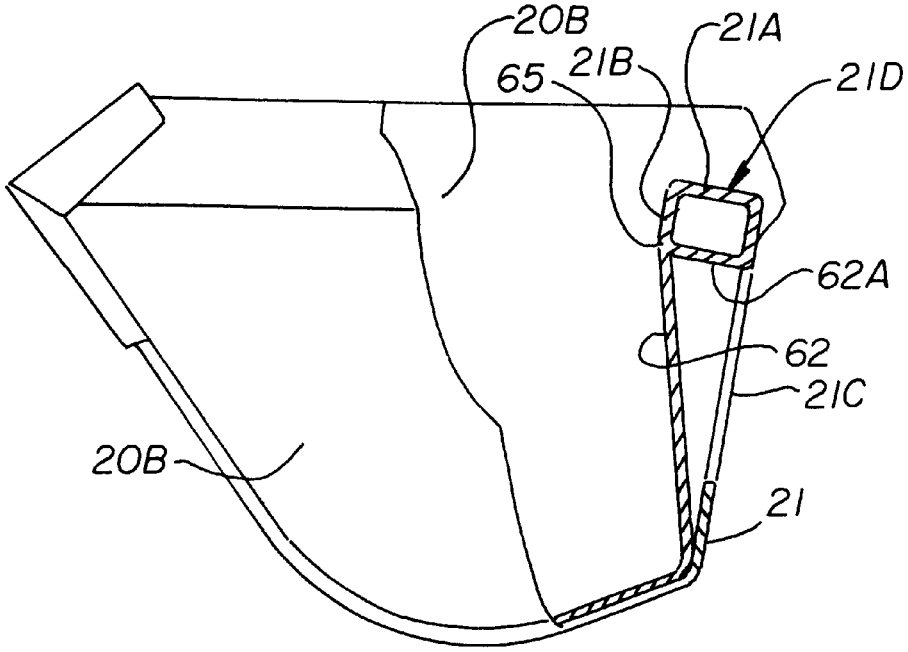
FIG. 13 is a side elevational view of a bucket used with the present invention before a frame is attached, with parts in section and parts broken away.
Figure 14:
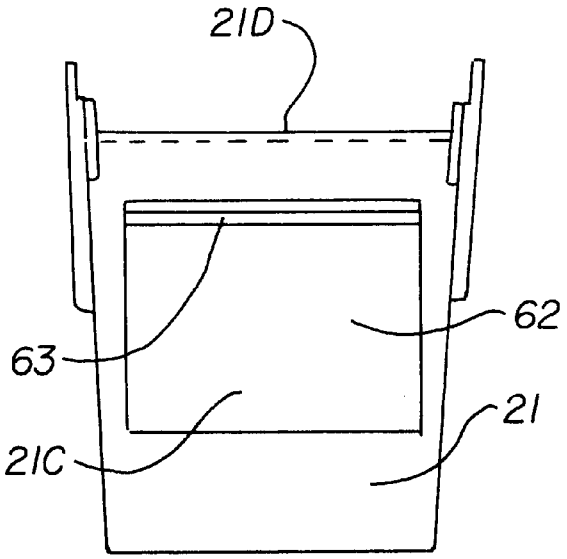
FIG. 14 is a rear view of the bucket of FIG. 13.

The wall 21 of the bucket 20 at the rear of the open side is formed with an inverted channel edge portion 21D, as perhaps can be seen by referring to FIGS. 13 and 14 as well as FIGS. 9 and 11. The wall 21 edge portion 21D is near the open end of the bucket 20 formed with a base wall 21A and a flange 21B is formed back toward the opposite end of the wall 21. An opening 21C is formed in the wall 21 to receive the formed plate 52 of the frame 48, and edge portions of the side plates 50 that extend out from the plate 52 to provide a welding surface. A liner wall 62 is used on the interior side of the wall 21 and tapers away from wall 21 in direction toward the open end of the bucket. The wall 62 has a flange 62A that is welded back to the wall 21 to enclose the opening 21C. The wall 62 is also welded to the side walls of the bucket when the walls 21 and 62 are installed on a bucket. The wall edge portion 21D is carefully formed since it is used in the mount of the frame on the bracket 24. The bend where the flange 62A joins the main portion of the liner wall 62 is welded to the edge of flange 21B of the wall 21, so the plane of the face 65 of the flange 21B relative to the plane of the wall 21, and the plane of the plate 52 can be closely controlled. The assembly of the wall 21 and walls 62 is used for a number of tools so the frame 48 is easily mounted.

As may be seen in FIG. 9, when the frame 48 is welded to the back wall 21A, the rim flange 52C is mounted against the wall 21A and the wall 52 is placed so flange 52A and the wall section 52F are also tightly against the wall 21. The distance from the plane 52D and the plane of surface 65 is closely controlled.

The first step for mounting the tool, as shown the bucket 20, is shown in FIG. 1. The bucket is considered as having been set on the ground in the position shown, with the frame 48 at the top. The excavator arm 16 is moved so that the quick attachment bracket 24 is adjacent the bucket 20. The bracket 24 is tilted so that the channel 40 is facing generally toward the frame 48, with the rod 38 above the ears 54 of the frame.

Figure 5:
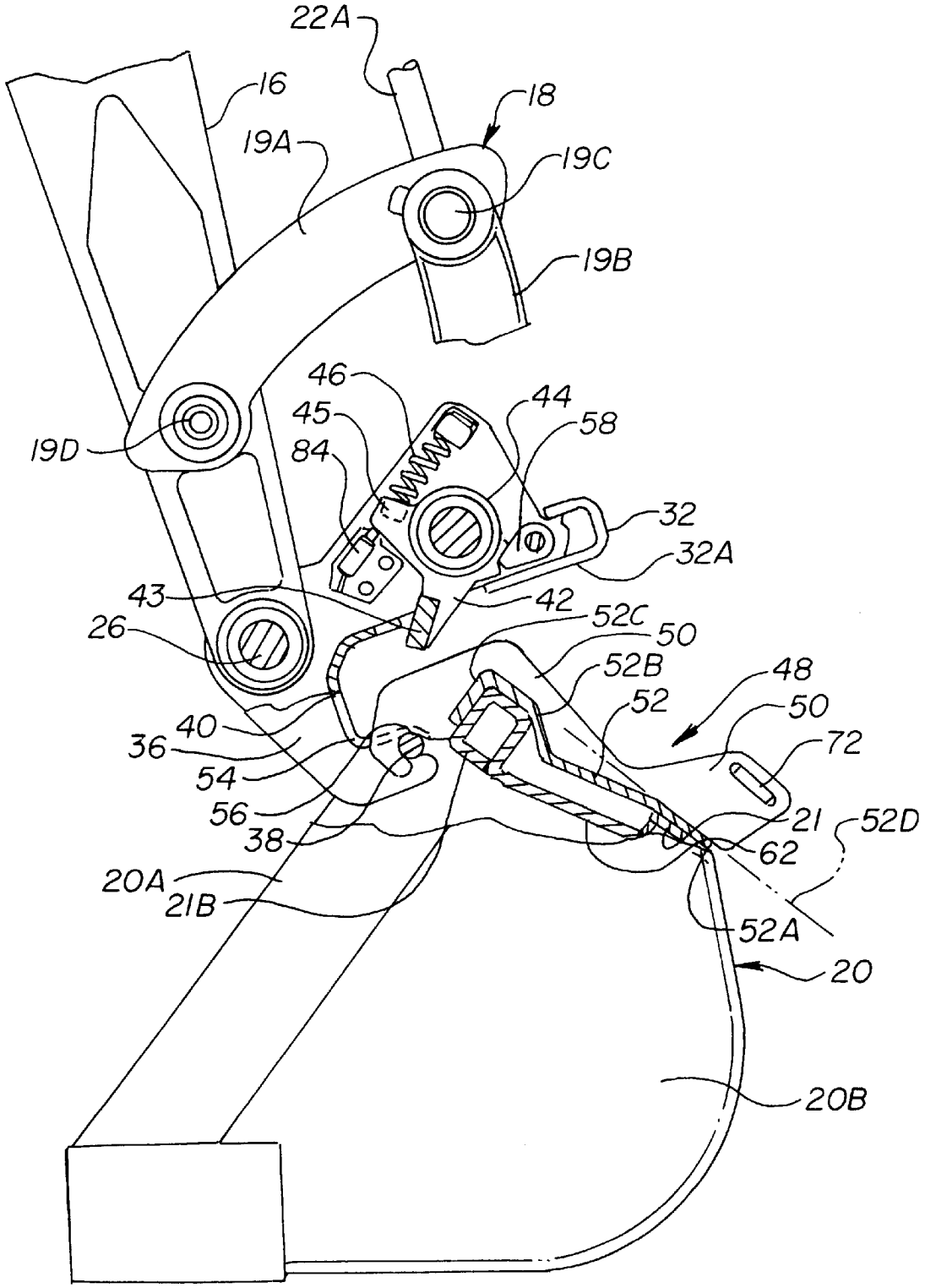
FIG. 5 is a side elevation view showing the arm in another stage of attaching the bucket showing a rod on the bracket in position to support a bucket and to position it for attachment through a hook on the bucket frame.

In FIG. 5 in the sequence of attaching the frame 48 and the bucket 20 to the quick attachment bracket 24, it can be seen that the arm 16 has been moved to a position where the pin 38 rests in the receptacles 56 of the frame 48 on the bucket 20. Again, the hooks 54 on the side plates 50 of the frame fit to the outside of the quick attachment bracket side plates 30.

The arm 16 can now be lifted and the bucket 20 will hang from the quick attachment bracket 24, so it can be moved or positioned where desired for finishing the attachment coupling. The suspension of the bucket on rod 38 through hook end 54 and receptacles 56 position the bucket and frame 48 properly for automatic attachment. This also illustrates that when uncoupling the bucket, the bracket 24 can be released from the frame 48 and the bucket will not fall to the ground, but rather will be supported on the rod 38 and the hooks 54 which have receptacles 56 for the rod 38.

The rod 22A of the hydraulic cylinder or actuator 22 is extended so that the linkage 18 tilts the quick attachment bracket 24 to a position where the plate portion 32A of the wrapper nose 32 rests on the flange 52A of plate 52 of the frame 48, as shown in FIG. 6. The open end of the channel 40 is aligned with the flange 52C and the end of the wall of the 21, including the end wall 21A and the flange 21B, which are removed from FIG. 6 for clarity.

As the bracket 24 is moved to the position shown in FIG. 6 the latch 41, which was protruding from the frame and held there by pawl 58 is forced to the position shown in FIG. 6, to ride on plate portion 52F against the action of springs 46, which urge the latch in counterclockwise direction. The bucket has to resist the force of the springs 46 as the bracket is slid to the position of FIG. 6. The pawl 58 is spring loaded in clockwise direction, as seen FIG. 6, with a torsion spring 58A that has a leg that fits under the pawl end and when the latch is moved by the frame plate 52 as the bracket is slid into place the pawl moves away from the stop surface 59B and will rest against the lug 59 on the latch.

The next step in attaching or mounting the bucket on the quick attachment bracket 24 is to move the bracket in direction indicated by the arrow 70 in FIG. 6, to slide the bracket so the nose piece 32 slides linearly under a retaining bar or across member 72 that is mounted on and extends between the side plates 50 of the frame 48 to form a retainer receptacle. The retaining bar 72 holds the nose piece 32 against the flange 52A of the plate 52, and the latch 41 moves so the latch end 43A, which is rounded with a large radius, engages the surface of inclined latch section 52B to prevent the bracket 24 from reversing relative movement with respect to the frame 48 and uncoupling. The frame 48 and attached tool, as shown, the bucket 20, are ready for use.

Figure 8:
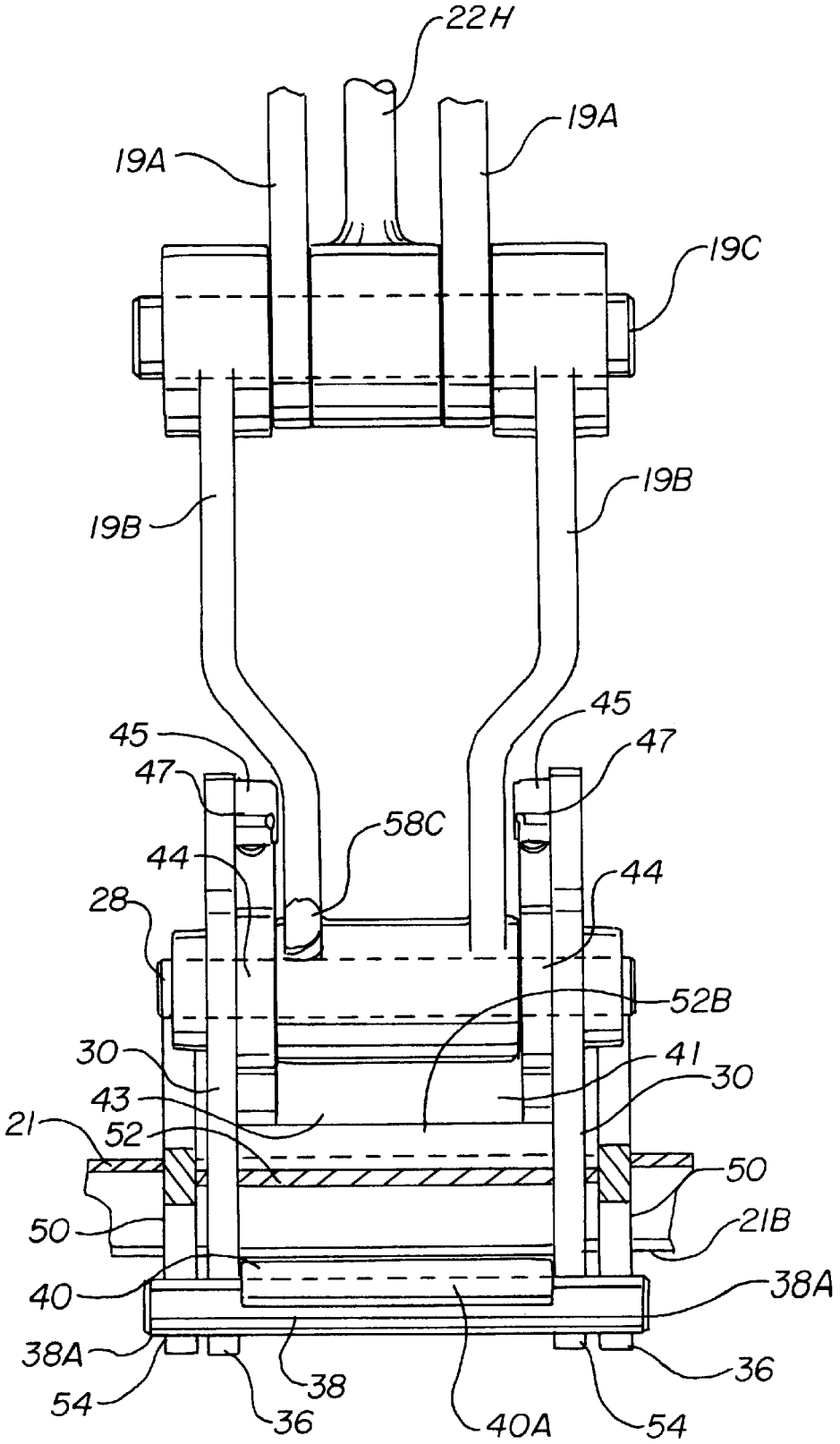
FIG. 8 is fragmentary sectional view taken on line 8—8 in FIG. 7, with the bucket walls removed for clarity.

FIG. 8 is a sectional view take on an irregular sight line to illustrate the frame 48 and latch 41 in latched position with parts removed for clarity. The bucket sides are not shown, but an end view of the flange 21B against the outer leg 40B of the channel shaped saddle 40 is shown.

FIG. 9 is an enlarged sectional view of the bracket 24 and frame 48 in fully engaged or mounted position. The main panel 32A of nose piece 32 is held against frame flange 52A and is held from moving away from the frame 48 and frame plate 52. The nose piece 32 is free to slide away from the retainer bar 72 but is retained in position by the latch 41 acting against the tapered wall section 52B of the frame plate 52.

The channel shaped saddle 40 is made so that it will accommodate wear in combination with the frame and the edge portion 21D of wall 21 formed by walls 21A and 21B. The channel shaped saddle 40 includes a first leg 40B that supports the lip 40A, and this wall 40B is parallel to the plane 52D of the plate 52. It is also parallel to the wall or flange 21B of the bucket back wall top edge portion 21D.

The channel shaped saddle 40 has a base 40C that is parallel to and spaced slightly from the rim flange 52C of the plate 52. The saddle further has an inclined formed corner wall section 40D that extends at an angle to the base 40C and which joins the side wall 40E. The inner surface 40F of the inclined corner wall section 40D acts as a cam surface against the corner of the frame plate formed between plate wall section 52F and the plate rim flange 52C. The cam surface 40F and the corner engage at a tangent point indicated at 76 in FIG. 9. The forces from the latch 41 and the seating forces developed when the bracket 24 is pushed into latched position in turn cause the cam surface 40F to force the wall 21B against the inner surface of the saddle wall 40B, along line 78 (FIG. 9) to eliminate play or movement when held with the latch 41. The tightening action will continue as the corner wears because of the cam surface 40F, so the latch bracket 24 and frame 48 will not loosen excessively. Also, the cam action insures tight seating of the parts even with manufacturing variations.

FIG. 11 shows a first stage in the unlatching of the frame 48 and bracket 24. The latch 41 is moved to a position to clear the surface of plate section 52B, The latch 41 is rotated against the force of springs 46 either by mechanically prying the latch clockwise with a pry bar used in a receptacle 80 (see FIG. 10) acting through a slot 81 in the bracket side plate 30 (see FIG. 4) or by operating small hydraulic cylinders 84 having rods 85 that are mounted on brackets 86 bolted or otherwise fixed to the sidewalls 30 of the quick attachment bracket 24. The rods 85 of the cylinders are positioned to act on the respective lugs 45,and are single acting cylinders that are operated with a valve 83 (see FIG. 11). When the pistons 85 are extended, as shown in FIG. 11, the latch 41 is pivoted clockwise to a position where the latch end clears the surface of plate section 52B and the pawl 58 will snap under its torsion spring load to engage the stop surface 59A to hold the latch in its disengaged position.

Figure 12:
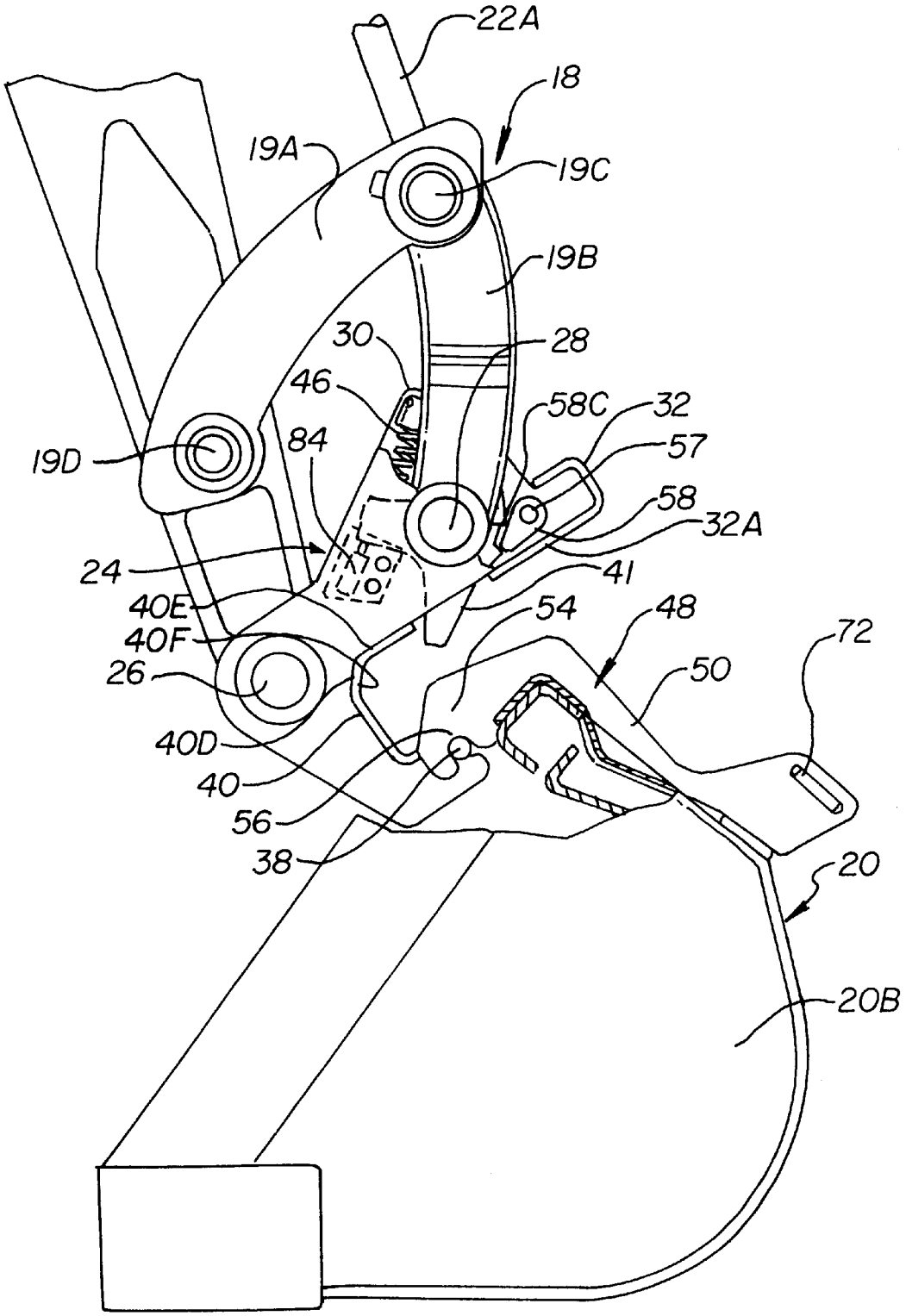
FIG. 12 is a view showing the quick attachment bracket being rotated from the bucket, wherein the bucket can be supported on hooks and returned to be supported on the ground.

The arm 16 can then be actuated to back the bracket out from under the bar 72 so the frame and bucket can roll out of the bracket. The hooks 54 are positioned so that if the removal action is done with the bucket off the ground, the bucket will not fall free, but the hooks 54 and receptacles 56 will catch the ends 38A of rod 38 to hold the bucket, as shown in FIG. 12. The excavator can then be operated to deliver the bucket to a storage location and when the bucket is supported on the ground or other support, it can be released by manipulating the arm 16 or the bracket 24 by operating the actuator 22.

The reset of the pawl 58 to hold the latch 41 in its ready position for reattaching the frame 48 is automatically done when the bracket is rotated to the position shown in FIG. 12. One of the sides of the link 19B has an actuator button 58C that is a protrusion which strikes the pawl 58 when the bracket 24 is rolled to its position shown in FIG. 12 as the bracket is removed from the frame 48. When the pawl 58 is slid off the surface 59A, the springs 46 kick the latch counterclockwise and the pawl spring 58A keeps the pawl against the stop lug 59 so the pawl end engages the surface 59B and holds the latch in position shown in FIG. 1. The protrusion or button 58C on the link 19B can be seen in FIGS. 1 and 9 as well. The hydraulic cylinder 84 can act as a stop for the latch 41 to hold it in its ready position, if a hydraulic release cylinder is used on the bracket 24.

The bucket construction shown in FIGS. 13 and 14 for the frame 48 for the quick attachment bracket also is usable when a pinned bucket is desired. The pinned bucket is one where it is pivoted directly to the end of arm 16 and also directly to the end of link 19B.

Figure 15:
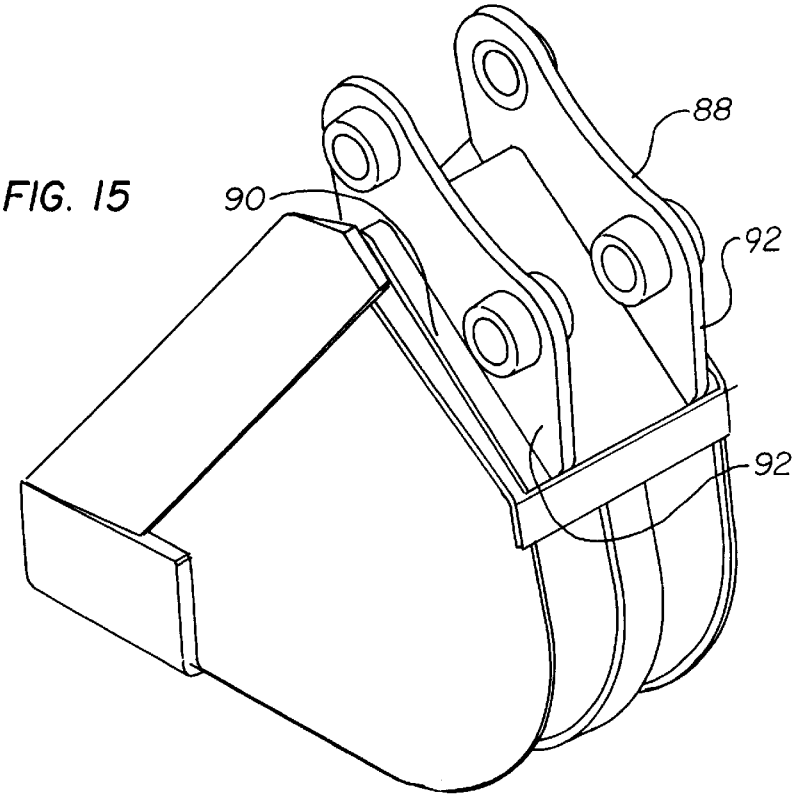
FIG. 15 is a perspective view of a bucket utilizing a common mounting plate but for a pin mounting assembly.

As shown in FIG. 15, a pinned bracket 88 comprises a flat plate 90 that fits against the outer surface of wall 21, and which covers the opening 21C and is welded in place. The plate has a bent over end that fits around the end wall 21B for positioning. The plate carries pin brackets 92 that have bores for receiving pins to directly mount the bucket to the arm 16 and link 19B.

Figure 16:
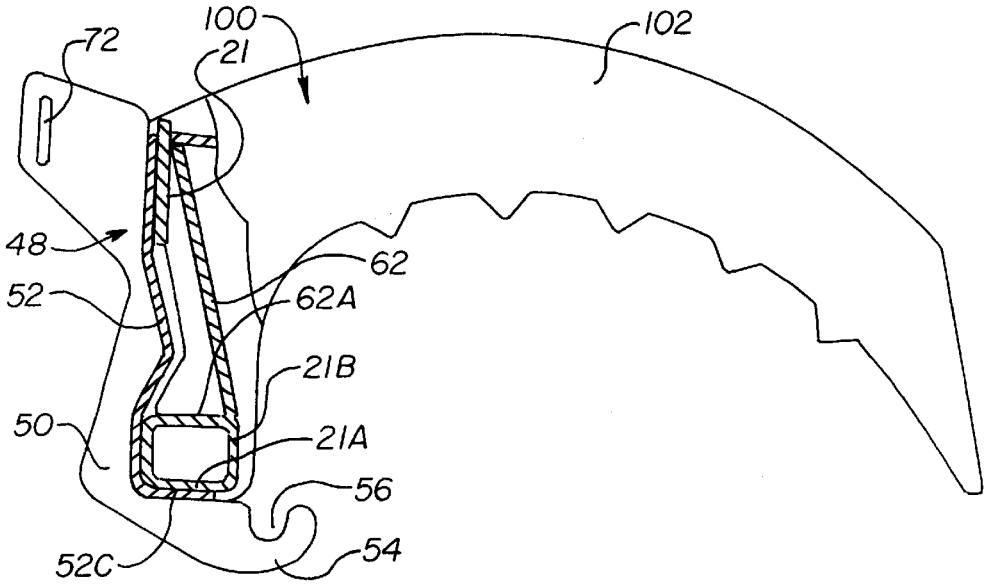
FIG. 16 is side view of a grapple utilizing a frame that can be coupled to the quick attachment bracket of the present invention with parts in section and parts broken away.

FIG. 16 shows a grapple 100 that has three spaced grapple teeth 102 (two are shown where the closest one is broken away). The teeth 102 are mounted on the same wall assembly as used with the bucket, including on wall 21 that has an end wall 21A and a flange 21B for mounting the plate 52 and bracket 48. The wall 21 includes the opening 21C to receive the formed plate 52. The wall 62 and flange 62A are also used.

The frame 48 can be welded in place on the grapple and then attached to the bracket 24, as shown in the previous figures.

Grapples are used with "thumbs" or other reaction members against which the grapple will clamp loads, and the quick attachment bracket and frame permits changing the grapple to a different style without unpinning the thumb or reaction member. This greatly simplifies changing the grapples.

It should be noted that the frame 48 is used on buckets of all sizes, and wider buckets are accommodated easily, without altering the frame.

Fast reliable operation for interchanging buckets or other tool is achieved. The ability to remove the bucket with the bucket off the ground without having the bucket fall freely is helpful, and is achieved by use of the overlapping ears and receptacles on the frame 48, in combination with the rod 38.

Any wear between the plate 52 and the channel saddle 34 will occur on the corner of the plate 52. The line of contact between the end of latch 41 and the tapered surface of the plate 52 will move up the surface on wall portion 52B and continue to latch the unit tightly in place. The latch 41 is spring loaded in counter clockwise direction. Normal manufacturing tolerances are also accommodated.

The plate 21 and liner plate 62 can also be applied to tools for mounting the frame 48 on the tool for use with quick attachment bracket. Power augers and concrete breakers can thus be attached and removed easily.

Although the present invention has been described with reference to preferred embodiments, workers skilled in the art will recognize that changes may be made in form and detail without departing from the spirit and scope of the invention.

What is claimed is:

1. A quick attachment bracket and frame assembly for use with an implement having a power actuated attachment assembly mounted on an implement arm, comprising a frame attachable to a tool, said frame including a plate having planar sections, and having a pair of side plates supported on the plate, the frame having a retainer receptacle at one end and a rim flange at an opposite end, the frame being used in combination with a quick attachment bracket pivotally mountable on an earthworking implement arm, said bracket fitting between the side plates and including an end portion linearly slidable into the retainer receptacle on the frame and a support for receiving the rim flange of the frame as the frame is slidably moved into the retainer receptacle, and a member for retaining the end portion in the retainer receptacle of the frame to prevent the frame from moving linearly in a direction away from the support and retainer receptacle when the rim flange of the frame is seated on the support.

2. The assembly of claim 1, wherein the plate has an inclined surface that inclines away from the bracket and the member for retaining comprises a pivoted latch member on the bracket that is spring loaded to engage the inclined surface of the plate when the rim flange of the frame is seated on the support, said latch member being spring loaded to pivot in a direction toward the inclined surface, said bracket being slidable in a direction along the frame to cause the rim flange of the frame to fit in the support, and said end portion of the bracket comprising a nose that slides into the retainer receptacle on the frame for retaining the nose from movement away from the frame.

3. The assembly of claim 2 and a hydraulic actuator mounted on said bracket to urge the latch to pivot in a direction away from the inclined surface against the spring load on the latch.

4. The assembly of claim 2, wherein said retainer comprises a bar spanning the frame side plates and spaced from a planar section of the plate.

5. The assembly of claim 2 and a stop member on the latch member having a stop surface, a pawl pivotally mounted on the bracket and engageable with the stop surface to prevent the latch member from moving about its pivot under the spring load more than a selected distance.

6. The assembly of claim 5, wherein said stop member has a second stop surface, and said pawl being engageable with said second stop surface whereby the pawl is held in a position clearing the inclined surface of the plate as the bracket and frame are moved relative to each other.

7. The assembly of claim 6, wherein said assembly includes a pivot for mounting the bracket to a support arm, a linkage for controlling pivotal movement of said bracket about said pivot, said linkage including a pair of links pivotally mounted in center portions with one of the links pivotally mounted about a common pivot with the latch member to the bracket, and said one link having a member which engages the pawl to remove the pawl from the second stop surface when the bracket is pivoted to a selected position about said pivot.

8. The assembly of claim 1, wherein said frame is attached to a tool having a wall with an edge portion, with the rim flange of said frame adjacent the edge portion and having a part of said plate perpendicular to said flange engaging the edge portion of the wall of the tool, the edge portion of the tool extending beyond said rim flange and having a wall substantially parallel to a main portion of the plate adjacent the flange, the support comprising a generally channel shaped saddle for receiving the rim flange of the frame and an edge portion of the wall of the tool on which the frame is mounted.

9. The assembly of claim 1, wherein said support saddle comprises a saddle having a base wall, a pair of spaced apart walls coupled to the base wall, a first of said spaced apart walls being coupled to the base wall by an inclined wall portion that extends out of the plane of the plate of the frame to the base wall, said inclined wall portion being configured for engaging a corner formed between the rim flange and an adjacent main portion of the plate, whereby as the saddle moves toward the rim flange, the rim flange is urged toward a second of the spaced apart walls of the saddle.

10. The assembly of claim 1 wherein said frame side plates extend beyond the rim flange and have hook receptacles formed therein for receiving a support rod, said bracket having a support rod that is of sufficient lateral size to be engaged by the hook receptacles to support the frame on the support rod when the frame is moved so that the rim flange is spaced from the support.

11. A quick attachment bracket for an implement arm for attachment to a frame member secured to a tool, said frame member having a wall member having an edge, said bracket including a pair of bracket side plates; and a cross member joining said bracket side plates and holding the side plates in spaced-apart relationship, said cross member forming a saddle open in a first direction for receiving the edge of the frame member by sliding the bracket in the first direction.

12. The quick attachment bracket of claim 11 wherein said saddle has first and second spaced walls and a base joining the first and second walls; and said edge of the frame comprises a channel with a pair of substantially parallel walls, a first of said parallel walls being substantially contiguous to the first wall of the cross member when the formed edge is in the saddle, a second of said parallel walls of said channel being spaced a known distance from and being parallel to the second wall of the saddle cross member.

13. The quick attachment bracket of claim 12 wherein said channel has a rounded corner at an end of the first parallel wall, said first wall of the saddle having a wall section that tapers from a main portion of the first wall toward the base of the saddle, the second wall of the saddle being spaced from the main portion of the first wall such that the rounded corner of the channel engages said tapered wall section of the saddle and forces tending to move the saddle in the first direction toward the channel urging the second parallel wall of the channel against the second wall of the saddle.

14. The quick attachment bracket of claim 13 wherein said bracket has a latch member for engaging a latch portion of the frame member, said latch member urging said bracket in direction opposite from the first direction to, seat the channel into the saddle, and said latch member preventing opposite separating movement of said channel relative to the saddle until the latch member is selectively released.

15. The quick attachment bracket of claim 13 and a retainer to provide the forces tending to move the saddle in a first direction.

16. The quick attachment bracket of claim 15 wherein said frame extends in the first direction to a second end opposite from said edge, a pair of side members on said frame member with a cross member joining said side members to form a receptacle relative to a wall of the frame member, said bracket fitting between the side member and the receptacle receiving an end portion of the quick attachment bracket to retain the quick attachment bracket for movement away from the frame member as the saddle receives the channel formed at the edge of the frame member.

17. The quick attachment bracket of claim 11, wherein said frame extends in a first direction from the edge, a receptacle having an opening facing in a direction opposite from the first direction at an end of said frame member opposite from the edge, the bracket having a rim that is moved into the receptacle as the bracket is slid in the first direction and the edge of the frame member is received in the saddle.

18. The quick attachment bracket of claim 17 and retainer between the frame member and bracket for holding the edge of the frame member in the saddle.

* * * * *